US010299359B2

(12) United States Patent
Matsuo

(10) Patent No.: US 10,299,359 B2
(45) Date of Patent: May 21, 2019

(54) LIGHTING CONTROL CONSOLE, LIGHTING SYSTEM USING THE SAME, AND CONTROL METHOD OF LIGHTING FIXTURE

(71) Applicant: Panasonic Intellectual Property Management Co., Ltd., Osaka (JP)

(72) Inventor: Akane Matsuo, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/033,255

(22) Filed: Jul. 12, 2018

(65) Prior Publication Data

US 2019/0021152 A1 Jan. 17, 2019

(30) Foreign Application Priority Data

Jul. 13, 2017 (JP) ..... 2017-137281

(51) Int. Cl.
*H05B 37/02* (2006.01)
*H05B 33/08* (2006.01)
*G05G 9/047* (2006.01)

(52) U.S. Cl.
CPC ..... *H05B 37/029* (2013.01); *G05G 9/047* (2013.01); *H05B 33/0845* (2013.01)

(58) Field of Classification Search
CPC ..... H05B 37/029
USPC ..... 345/161, 162, 102; 315/293, 209 R, 219, 315/276, 291
See application file for complete search history.

(56) References Cited

U.S. PATENT DOCUMENTS 5,502,627 A * 3/1996 Hunt ..... H05B 37/029 318/603
6,255,787 B1 * 7/2001 Belleveau ..... H05B 37/0245 250/205

FOREIGN PATENT DOCUMENTS

| | | | |
|---|---|---|---|
| JP | H04-062703 | A | 2/1992 |
| JP | H06-290604 | A | 10/1994 |
| JP | H07-312296 | A | 11/1995 |
| JP | H08-138871 | A | 5/1996 |
| JP | H11-251074 | A | 9/1999 |
| JP | 2009-129786 | A | 6/2009 |

* cited by examiner

*Primary Examiner* — Thuy V Tran
(74) *Attorney, Agent, or Firm* — McDermott Will & Emery LLP

(57) ABSTRACT

The lighting control console and a control method using the lighting control console are disclosed. The lighting control console includes an operation device, a control device that controls a lighting fixture, and a storage that stores position information of a plurality of points. The storage stores a plurality of paths connecting two points. The operation device accepts first and second operation inputs. The control device controls the lighting fixture so as to move a lighting position along a first path determined out of the plurality of paths in accordance with the first operation input at a speed in accordance with an input amount of the first operation input. The control device controls the lighting fixture so as to change the lighting position onto a second path adjacent to the first path upon the second operation input exceeding a predetermined threshold while the lighting position is moving along the first path.

8 Claims, 4 Drawing Sheets

LIGHTING CONTROL CONSOLE, LIGHTING SYSTEM USING THE SAME, AND CONTROL METHOD OF LIGHTING FIXTURE

CROSS REFERENCE TO RELATED APPLICATION

The entire disclosure of Japanese Patent Application No. 2017-137281 filed on Jul. 13, 2017, including the specification, claims, drawings, and abstract is incorporated herein by reference in its entirety.

TECHNICAL FIELD

The present disclosure generally relates to a lighting control console, a lighting system using the same, and a control method of a lighting fixture, and more particular to a lighting control console which controls a lighting fixture used, for example, in a wedding hall, a banquet hall, a multipurpose hall or the like, a lighting system using the same, and a control method of the lighting fixture.

BACKGROUND

It is conventional to practice tracking lighting in which a movable lighting fixture such as a spotlight is caused to light a moving lighting target such, for example, as a person, and its lighting position is moved following the movement of the target. Exemplary ways of the tracking lighting include, for example, a method of manually operating the lighting fixture directly or through remote operation, and a method of controlling the lighting fixture to perform automatic tracking. Examples of the method of causing the lighting fixture to perform automatic tracking include, for example, a method of moving the lighting position of the lighting fixture in accordance with a preset schedule.

For example, Japanese Unexamined Patent Application Publication No. Hei8-138871 discloses a control device including a follow spotlight whose dimming states can be remotely controlled, and a console which controls the spotlight and the like. This control device is configured such that movement of the follow spotlight becomes continuous movement as a result of reproducing stored items in the order of the scene numbers after storing lighting points of the spotlight designated based on an image captured by a camera, control items of the spotlight input using input means, and control results of individual scenes along with scene numbers.

SUMMARY

Technical Problem

In the case of the manual tracking method, it is necessary to adjust two-dimensional inputs of the lighting position of the lighting fixture to the position coordinates of the lighting target, and in addition, such inputs must continue at all times during the lighting target moving. This leads to a large load on an operator and a high possibility of operation errors. In the case of the automatic tracking with the lighting fixture, it is common for the lighting target to temporally and spatially deviate from the preset schedule, which can cause a deviation between the lighting position and the lighting target. Therefore, the automatic tracking often ends up being switched to the manual operation.

It is an advantage of the present disclosure to provide a lighting control console with which positioning between a lighting target and a lighting position can be made easy, which relieves an operation load on a user, when tracking movement of the lighting target to move the lighting position of a lighting fixture, a lighting system using the same, and a control method of a lighting fixture.

Solution to Problem

There is provided a lighting control console according to the present disclosure, including: an operation device configured to accept an operation input for controlling a lighting fixture; a control device that transmits a signal for controlling the lighting fixture to the lighting fixture upon reception of an input signal transmitted by the operation device in response to operation input; and a storage in which position information of a plurality of points existing in a predetermined space is stored. In the storage, a plurality of paths connecting a first point and a second point out of the plurality of points are stored, the first point being a start point, the second point being a target point. The operation device is being configured to accept, as the operation input, a first operation input and a second operation input which are independent of each other. Upon reception of the input signal transmitted by the operation device in accordance with the first operation input, the control device controls the lighting fixture so as to move a lighting position of the lighting fixture from the start point toward the target point along a first path included in the plurality of paths stored in the storage, and to move the lighting position at a speed in accordance with an input amount of the first operation input. The control device controls the lighting fixture so as to change the lighting position onto a second path adjacent to the first path when the input signal transmitted by the operation device in accordance with the second operation input while moving the lighting position along the first path exceeds a predetermined threshold.

Advantageous Effects of Invention

According to the lighting control console according to the present disclosure, when the lighting position of a lighting fixture is caused to track movement of a lighting target using the relevant lighting control console, positioning between the lighting target and the lighting position may be easy, which may relieve an operation load on a user.

BRIEF DESCRIPTION OF DRAWINGS

Embodiments of the present disclosure will be described based on the following figures, wherein.

The figures depict one or more implementations in accordance with the present teaching, by way of example only, not by way of limitations. In the figures, like reference numerals refer to the same or similar elements.

DESCRIPTION OF EMBODIMENTS

Hereafter, embodiments according to the present disclosure will be described in detail with reference to the appended drawings. In the following description, specific numerical values, quantities, directions and the like are exemplarily presented for ease of understanding the present disclosure, and they can be appropriately modified so as to meet the specifications of a lighting system to which a setting method of a lighting fixture is applied. Moreover, when the following includes a plurality of embodiments and modifications, it is originally assumed to appropriately combine and use portions of those. Similar elements in all the drawings are given the same signs to be described below.

Figure 1:
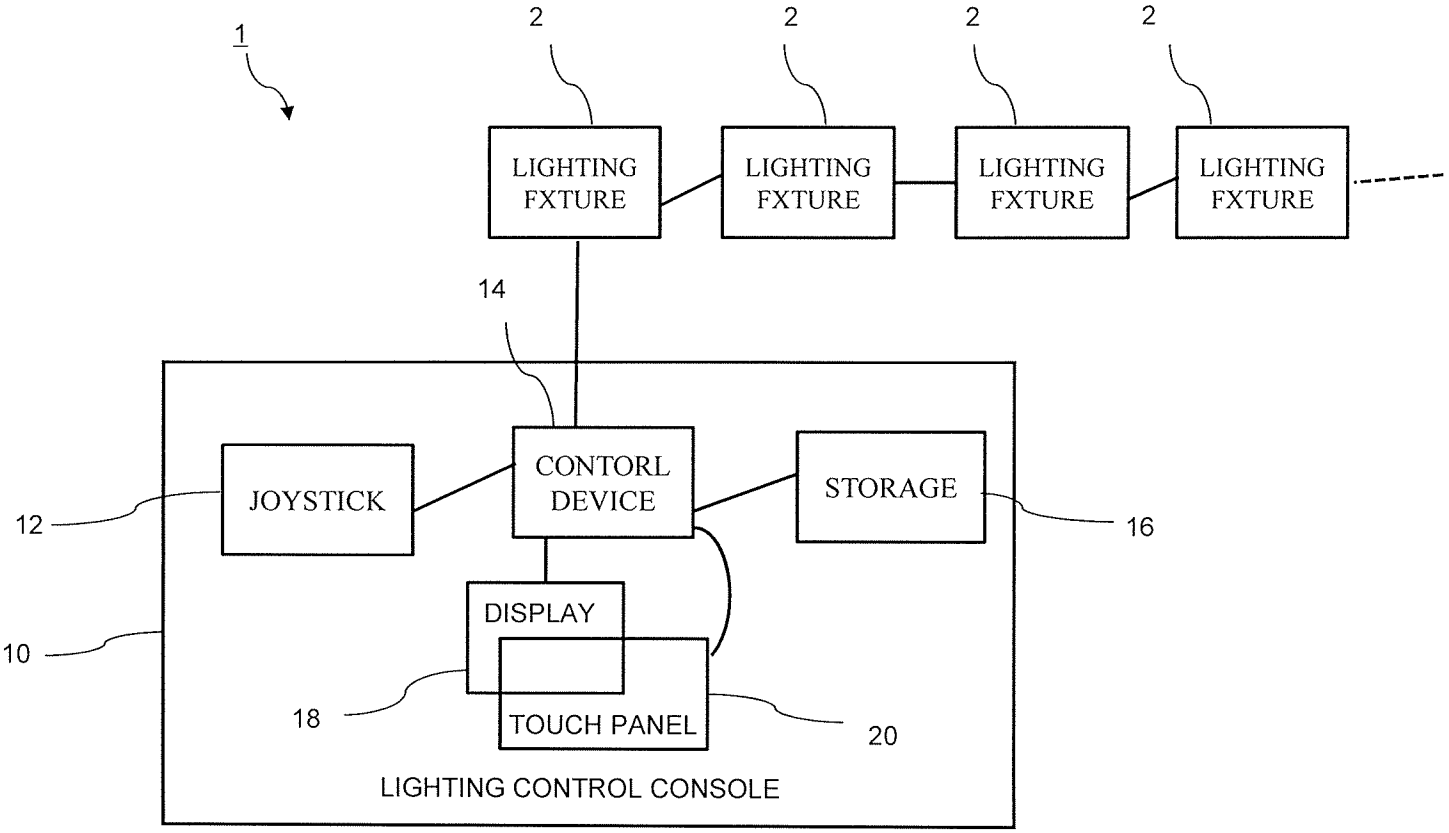
FIG. 1 is a block diagram exemplarily showing a configuration of a lighting system according to an example of an embodiment.

FIG. 1 is a block diagram exemplarily showing a configuration of a lighting system according to an embodiment of the present disclosure. The lighting system 1 according to the present embodiment includes a lighting control console 10 and lighting fixtures 2. The lighting control console 10 shown in FIG. 1 is configured to have a joystick (operation device) 12, a control device 14, a storage 16, a display 18 and a touch panel 20 (input device) 20.

Figure 2:
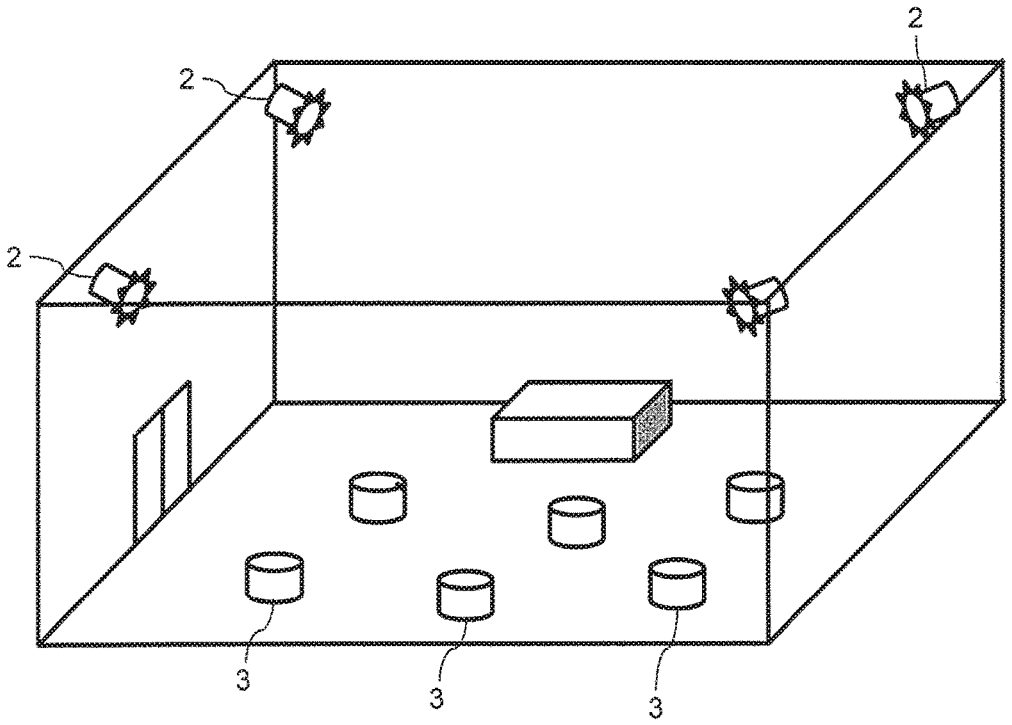
FIG. 2 is a schematic diagram exemplarily showing a lighting space whose lighting state is controlled by the lighting system according to an example of an embodiment.

FIG. 2 is a schematic diagram exemplarily showing a lighting space whose lighting state is controlled by the lighting system 1. In the lighting space shown in FIG. 2, a plurality of lighting fixtures 2 are arranged on the ceiling portion of the lighting space, and a plurality of tables 3 are arranged on the floor surface of the lighting space. While examples of the lighting space include, for example, a wedding hall, a banquet hall, a multipurpose hall, a stage (theater stage) and the like, it is not limited as long as it is an environment in which the lighting fixtures 2 can be installed.

The lighting fixture 2 is a movable spotlight, for example, having semiconductor light-emitting elements such as LEDs (Light Emitting Diodes). The lighting fixture 2 is connected to the control device 14 of the lighting control console 10 in a wired or wireless manner. The lighting fixture 2 is controlled in accordance with a signal (hereinafter also referred to as "control signal") for instruction of dimming states and the like transmitted from the control device 14. The dimming states include, for example, ON/OFF of the lighting fixture 2, a lighting position, a light beam, a color tone and the like, not being limited thereto. Thereby, lighting representation is possible in an environment where the lighting fixtures 2 can be installed. In the lighting system 1 shown in FIG. 1, each lighting fixture 2 has an input terminal and an output terminal, and the lighting fixtures 2 are connected in series by connecting the input terminal of one lighting fixture 2 to the output terminal of another lighting fixture 2. Note that the number and the type of lighting fixtures 2 used for the lighting system 1 are not limited as long as the dimming states of the lighting fixtures 2 can be controlled by the lighting control console 10. Moreover, the dimming states of the lighting fixtures 2 can be appropriately controlled by a known method depending on the lighting fixtures 2 used. For example, as the lighting fixtures 2, there may be used halogen lamps, metal halide lamps or the like. In that case, the dimming states of the lighting fixtures 2 may be controlled via a dimming console which receives the control signal transmitted by the lighting control console 10 and performs control such as phase control and power supply control on the lighting fixtures 2.

Returning to FIG. 1, the lighting control console 10 is described. The lighting control console 10 includes, for example, the joystick 12, the control device 14, the storage 16, the display 18 and the touch panel 20. The lighting control console 10 controls lighting of the lighting fixtures 2, for example, arranged at predetermined positions in a lighting space such as a wedding hall.

The joystick 12 functions as an operation device configured to accept operation inputs for controlling the lighting fixtures 2. The joystick 12 has, for example, an operation lever which can be inclined in two-dimensional directions, and a detection mechanism which detects a vector quantity corresponding to inclination directions and inclination angles of the operation lever. The operation lever is supported so as to be able to be inclined in all the surrounding directions from the center position. The detection mechanism separates an inclination component in a first direction and an inclination component in a second direction perpendicular to the first direction with respect to the operation lever from each other to detect and output the inclinations components as an electric signal. Namely, the detection mechanism is configured to detect an x-component and a y-component in the case where the vector quantity corresponding to the inclination of the operation lever is presented on the x-y-Cartesian coordinates and output them as the electric signal. In the lighting control console 10 according to the present embodiment, there are matched with one another the coordination axes in the right-left direction as seen by a user for the lighting space in the hall, the operation input direction of the joystick 12, and a floor diagram displayed on the display 18 mentioned later so as to be in the same direction. Thereby, the lighting fixtures 2 can be controlled based on feeling of operating the joystick 12.

In the lighting control console 10, the control device 14 performs processing of signals and various kinds of control. The control device 14 is connected to the operation device, and receives an input signal transmitted by the operation device that has accepted the operation input. Moreover, the control device 14 generates a control signal for controlling the dimming states of the lighting fixtures 2 to transmit it to the lighting fixtures 2. For example, when the dimming states of the lighting fixtures 2 are controlled by execution of a program or the like, the control device 14 performs predetermined calculation based on information regarding the lighting positions and the dimming states of the lighting fixtures 2, generates the control signal for controlling the lighting fixtures 2 such that they are in the instructed dimming states, and transmits the control signal to the lighting fixtures 2. Transmission of the control signal to the lighting fixtures 2 is performed as transmission of a dimming signal or the like, for example, having a DMX 512 format from a not-shown transmission device.

The control device 14 is made up, for example, of a microcomputer and includes a processor (processing device), which operates in accordance with a program, as a main hardware configuration. The control device 14 reads a program, data or a map, and the like stored in the storage 16 to perform predetermined operation. The processor may be of any type as long as it can realize its functions by executing a program. The processor is made up of one or plurality of electronic circuits including semiconductor integrated circuits (ICs) or an LSI (Large Scale Integration) circuit. The plurality of electronic circuits may be integrated into one chip, or may be provided on a plurality of chips. The plurality of chips may be collected into one device, or may be included in a plurality of devices.

The storage 16 stores various kinds of information. The information stored in the storage 16 can be read and written by the control device 14. The storage 16 is, for example, a memory, a hard disk drive or the like. As the storage 16, there may be used a temporary recording medium such as an optical disc and a flash memory. The storage 16 stores various control programs, information data, maps and the like for the control device 14 executing predetermined processing. The programs may be previously stored in the storage 16, or may be supplied to the storage 16 via wide area networks including the Internet and the like.

In the lighting control console 10 of the present embodiment, the storage 16 previously records information such as, for example, the arrangement, the number and the movable ranges of the lighting fixtures 2 installed in the lighting space. Moreover, as mentioned later, in the present embodiment, the storage 16 also stores, for example, information regarding points P (mentioned later) and paths L (mentioned later) which a lighting position of the lighting fixture 2 passes through in tracking operation, information (control information) regarding control of the dimming states of the lighting fixture 2 associated with the points P, and the like. Note that the lighting position is coordinates, for example, instructed by the control device 14 as the lighting direction of the lighting fixture 2.

The display 18 is made up, for example, of a liquid crystal display, an LED display or the like. The display 18 is not limited to these as long as it displays each screen needed for control and setting of the lighting fixtures 2 by the lighting control console 10. The display 18 is connected to the control device 14, and display of screens on the display 18 is controlled by the control device 14. The display 18 displays, for example, information indicative of the dimming states of the lighting fixtures 2 including the lighting positions, information indicative of the points P and the paths L mentioned later, and the like.

In the present embodiment, the touch panel 20 is disposed, for example, on the display 18. The touch panel 20 is configured to accept various inputs by the user pushing or touching with a pen or a finger (finger and the like) on an image displayed by the display 18, and functions as an input device. Thereby, the user can input information needed for operation and setting of the lighting control console 10 using the touch panel 20. A signal based on the input of the user is transmitted from the touch panel 20 to the control device 14.

Figure 3:
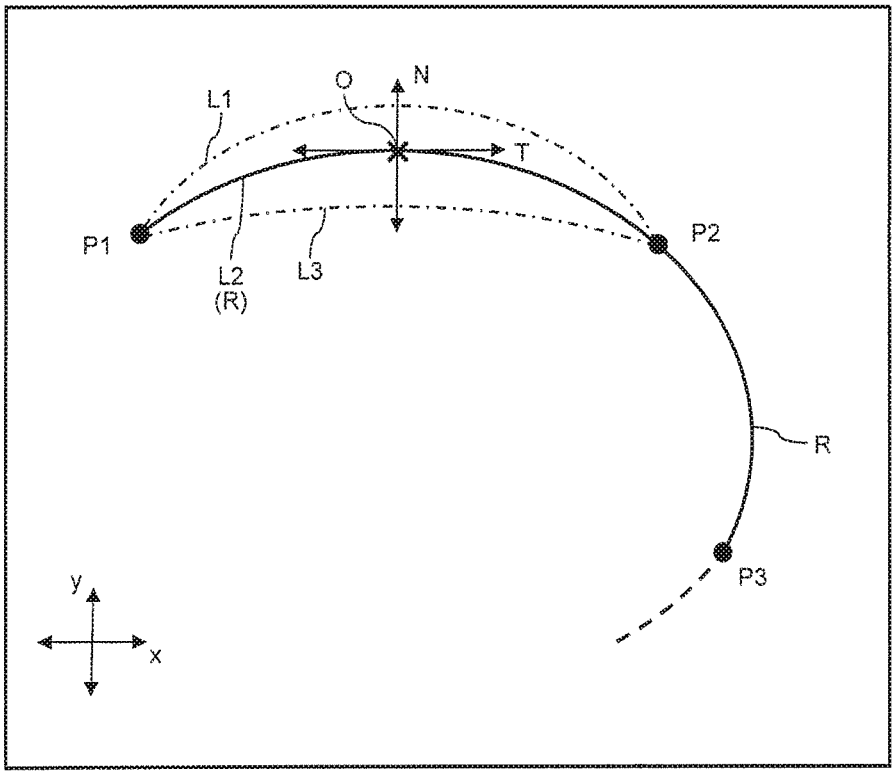
FIG. 3 is a conceptual diagram for exemplarily explaining movement of a lighting target and a control method of a lighting fixture according to an example of an embodiment.

Next, referring to FIG. 3, there is described a control method of the lighting fixture 2 using the lighting control console 10 and the lighting system 1 according to the present embodiment. FIG. 3 is a conceptual diagram for explaining movement of a lighting target and an example of the control method of the lighting fixture 2. In the following description, it is assumed that the lighting control console 10 and the lighting system 1 are used, for example, in a wedding hall in a scene where a spotlight is caused to track the bride and groom in synchronization with their movement. As a more specific scene, there can be exemplarily cited entering or exiting of the bride and groom, a ceremony (so-called "ceremony with lighting candles") in which the bride and groom sequentially move around the individual tables 3 at which their guests are seated, or the like.

In the scene where tracking lighting is performed as mentioned above, there is often predetermined a route R on which the lighting target moves in the hall. Therefore, the lighting position has been attempted to be automatically tracked. However, when such tracking lighting is actually performed, there has possibly been a case where the movement speed of the lighting target changes, or a case where the lighting target comes close to a guest, depending on the situation in the hall, and as a result, the lighting target has possibly been off the scheduled lighting position. Therefore, such an automatic tracking method has sometimes not been able to sufficiently handle a situation that actually happens, the method having difficulty in allowing for a deviation from the preset schedule. In such circumstances, the inventors have focused a situation where a route R on which the lighting target moves is predetermined as above and where actual movement of the lighting target does not largely deviate from the route R in time and in space.

FIG. 3 shows a partial horizontal plane (x-y-plane) of the lighting space. In FIG. 3, a lighting target O moves along the route R in the lighting space. On the route R, there are a plurality of points P1, P2, P3, . . . (also collectively referred to as "points P") which are spaced from one another. Numerals in the points P1, P2, P3 and the like represent the order in which the lighting position of the lighting fixture 2 is moved. Moreover, between the points P1 and P2, there are provided a plurality of paths L1, L2 and L3 (also collectively referred to as "paths L") each of which connects both points. Although, between the points P2 and P3, there are provided a plurality of paths L, each of which connects both points, they are omitted in FIG. 3.

In a tracking method using the lighting control console 10 and the lighting system according to the present embodiment, for example, there are designated the plurality of points P along the route R on which the lighting target O moves, and the lighting position of the lighting fixture 2 is moved along the path L, out of the plurality of points P, which is preset so as to connect the first point P1 and the second point P2.

In the example shown in FIG. 3, when the lighting target O is between the points P1 and P2, the lighting control console 10 moves the lighting position of the lighting fixture 2 along the path L2. This movement of the lighting position is controlled by the control device 14 in accordance with the input (hereinafter also referred to as "operation input") which the joystick 12 has accepted based on operation of the user. Specifically, the operation input is separated into a component in a tangential direction T (hereinafter also referred to as "first direction") to the path L and a component in a normal direction N (hereinafter also referred to as "second direction") thereto at the current position of the lighting target O by the control device 14 of the lighting control console 10. The control device 14 determines whether or not the joystick 12 receives the operation input along the first direction and whether or not it receives the operation input along the second direction based on the input amounts of the first directional component and the second directional component of the operation input. Next, the control device 14 controls the movement of the lighting position by the lighting fixture 2 in accordance with the first directional component and the second directional component of the separated operation input.

The first directional component of the operation input is associated with the movement of the lighting position along the path L. When the control device 14 determines that the joystick 12 receives the operation input along the first direction, it controls the lighting fixture 2 so as to move the lighting position along the path L at a movement speed in accordance with the input amount of the first directional component. In other words, the control device 14 receives a signal based on the first directional component from the joystick 12, and transmits a control signal to the lighting fixture 2 to move the lighting position of the lighting fixture 2 along the path L at the speed in accordance with the input amount of the first directional component. The second directional component of the operation input is associated with selection of the path L on which the lighting position is moved. When the control device 14 determines that the joystick 12 receives the operation input along the second direction, it compares the input amount of the second directional component with a predetermined threshold. The predetermined threshold is, for example, stored in the storage 16 and read by the control device 14. When the control device 14 determines that the input amount of the second directional component exceeds the predetermined threshold, it controls the lighting fixture 2 such that the path L on which the lighting position is moved is changed to an adjacent path L thereto in the direction of the operation input (inclination direction of the joystick 12). In other words, when a signal based on the second directional component received from the joystick 12 is larger than the predetermined threshold, the control device 14 transmits a control signal to the lighting fixture 2 to change the lighting position from the current position to a position on the adjacent path L in the direction in accordance with the second directional component.

With the case where the lighting position is at the lighting target O in FIG. 3, as an example, there is specifically described control of the lighting position based on the operation input received by the joystick 12. The first direction at the lighting target O, that is, the tangential direction T to the path L2, is the x-axis direction, and the second direction thereat, that is, the normal direction N to the path L2, is the y-axis direction. When the joystick 12 is inclined in the x-axis positive direction, the control device 14 moves the lighting position along the path L2 at the speed in accordance with the inclination angle of the joystick 12. When the joystick 12 is inclined in the y-axis positive direction and the control device 14 determines that the inclination angle of the joystick 12 exceeds a predetermined threshold, the control device 14 moves the lighting position from the lighting target O to the position at which the vector in the y-axis positive direction intersects the path L1.

By using the lighting control console 10 and the lighting system 1 configured as above, the user can perform tracking operations, for example, while observing the position of the lighting target O and the lighting position of the lighting fixture 2 visually or on a monitor screen. When the position of the lighting target O and the lighting position of the lighting fixture 2 are displaced from each other, the user can match the lighting position with the lighting target O instinctively by adjusting the inclination of the joystick 12. In a conventional manual tracking operation using the joystick 12, in order to match the lighting position with the lighting target, it is necessary to adjust both the x-axis directional component and the y-axis directional component of the operation input and to cause the lighting position to coincide with the lighting target. In the present embodiment, the lighting position moves only on the path L as long as the input amount of the second directional component does not exceed the threshold. Thereby, even if the inclination of the joystick 12 is slightly displaced with respect to the tangential direction T of the path L, the lighting position moves on the path L without deviating. As a result, the lighting position and the lighting target O coincide with each other. As mentioned above, the tracking operation of the lighting target O can be performed by one-dimensional operation input. Moreover, even if the lighting target O moves and deviates from the scheduled route R in the normal direction N, by largely inclining the joystick 12 in the direction corresponding to the normal direction N, the lighting position can be matched with the current position of the lighting target O. Then, the tracking operation can be subsequently performed by one-dimensional operation input along the updated path L. Accordingly, in the control method of the lighting fixture 2 of the present embodiment, positioning between the lighting target and the lighting position is easy, which relieves a tracking operation load on the user.

Next, there is described in a time series manner a specific example of the control method of the lighting fixture 2 using the lighting control console 10 of the present embodiment. The control method of the lighting fixture 2 described below is assumed, for example, to be used, in a wedding hall, in a scene where a spotlight is caused to track the bride and groom in synchronization with their movement on the occasion of a ceremony in which the bride and groom sequentially move around the individual tables 3 at which their guests are seated, or the like.

First, as preparation for performing control (hereinafter also referred to as "dimming control") of the dimming state of the lighting fixture 2, the user inputs various kinds of information to the lighting control console 10. Such input by the user is appropriately performed, for example, through the joystick 12 and the touch panel 20 included in the lighting control console 10, and another input device.

When the lighting control console 10 is started up, and, for example, the touch panel 20 accepts an input to an image region displayed for selecting a setting mode on the display 18, the control device 14 causes the display 18 to display a setting mode screen. Moreover, the control device 14 causes the display 18 to display an image corresponding to the horizontal plane of the lighting space in which performance of dimming control is scheduled, and waits for an input of points P mentioned later. The image displayed on the display 18 may be able to be expanded and shrunk as needed in accordance with user's input. Moreover, examples of the image displayed on the display 18 include, for example, a floor diagram associated with the lighting space which is the hall and in which the tables 3 and seats are arranged, and the like.

Next, in accordance with a movement route of the lighting target which is predetermined or predicted, there are input points P which the lighting position of the lighting fixture 2 is caused to pass through, within a region in which the aforementioned image is displayed. The input of the points P may be performed, for example, through the touch panel 20. The input points P also include a start point at which control of the lighting position of the lighting fixture 2 is started. Position information of the individual points P is stored in the storage 16, and the individual points P are displayed to be superimposed on the floor diagram displayed on the display 18. Next, in accordance with the movement route of the lighting target, an order of passing through the points P is input and stored in the storage 16. The lighting position of the lighting fixture 2 is controlled by the control device 14 so as to pass through the individual points P in accordance with this input order.

The control device 14 generates a plurality of paths L connecting two points P therebetween (for example, paths L connecting the first point and the second point). The path L has the start end at one (for example, the point P1 shown in FIG. 3) of the two points P, and the termination end at the other (for example, the point P2 shown in FIG. 3) thereof based on the passing order of the points P. For example, as shown in FIG. 3, the plurality of paths L are generated near the route R in an arrangement that interposes the route R between the plurality of paths L. The number of paths L generated by the control device 14 and the maximum value of the amplitude of the paths L can also be appropriately set. Setting of the maximum value of the amplitude of the paths L is performed, for example, by setting the distance between the middle point of the line segment connecting the two points P therebetween and the point at which the farthest path L from the route R intersects the bisector of this line segment. Thereby, in accordance with the scene and the situation in which the tracking operation is performed, a range of handling by the control method of the present embodiment can be appropriately set. The storage 16 stores the paths L generated by the control device 14. Note that in order to perform the control method of the lighting fixture 2 and the tracking operation of the present embodiment, for example, it is sufficient to set the points P which the lighting position of the lighting fixture 2 is caused to pass through, and information or setting of the route R on which the lighting target is to move are not necessary.

In the present embodiment, after designating the points P which the lighting position of the lighting fixture 2 is caused to pass through in the aforementioned setting mode, there information (control information) regarding control of the dimming state of the lighting fixture 2 associated with the designated point P may be preset. The storage 16 stores the control information of the lighting fixture 2 associated with the point P. The control information associated with the point P includes, for example, ON/OFF information of the lighting fixture 2 (that is, selection of the lighting fixture 2 of irradiation out of the plurality of lighting fixtures 2), the intensity of light, the focus, the irradiation range, the coordinates of the lighting position (xy-coordinates on the horizontal plane) and the height of the lighting position regarding irradiation by each lighting fixture 2, and similar information. Thereby, in the tracking operation using the lighting control console 10, when the lighting position of the lighting fixture 2 reaches the point P, based on the control information associated with the point P that it has reached, the dimming states of all the lighting fixtures 2 can be controlled as being preset without user input.

In the preparation stage for performing the dimming control of the lighting fixture 2, the storage 16 stores the aforementioned series of information input to the lighting control console 10 as one setting data. When performing tracking operation by the dimming control of the lighting fixture 2, the control device 14 appropriately reads the information stored in the storage 16 as the setting data. Note that the setting data may be transferred to the storage 16 using a temporary recording medium such as a memory card after the user creates the setting data using an external device such as a computer.

Figure 4:
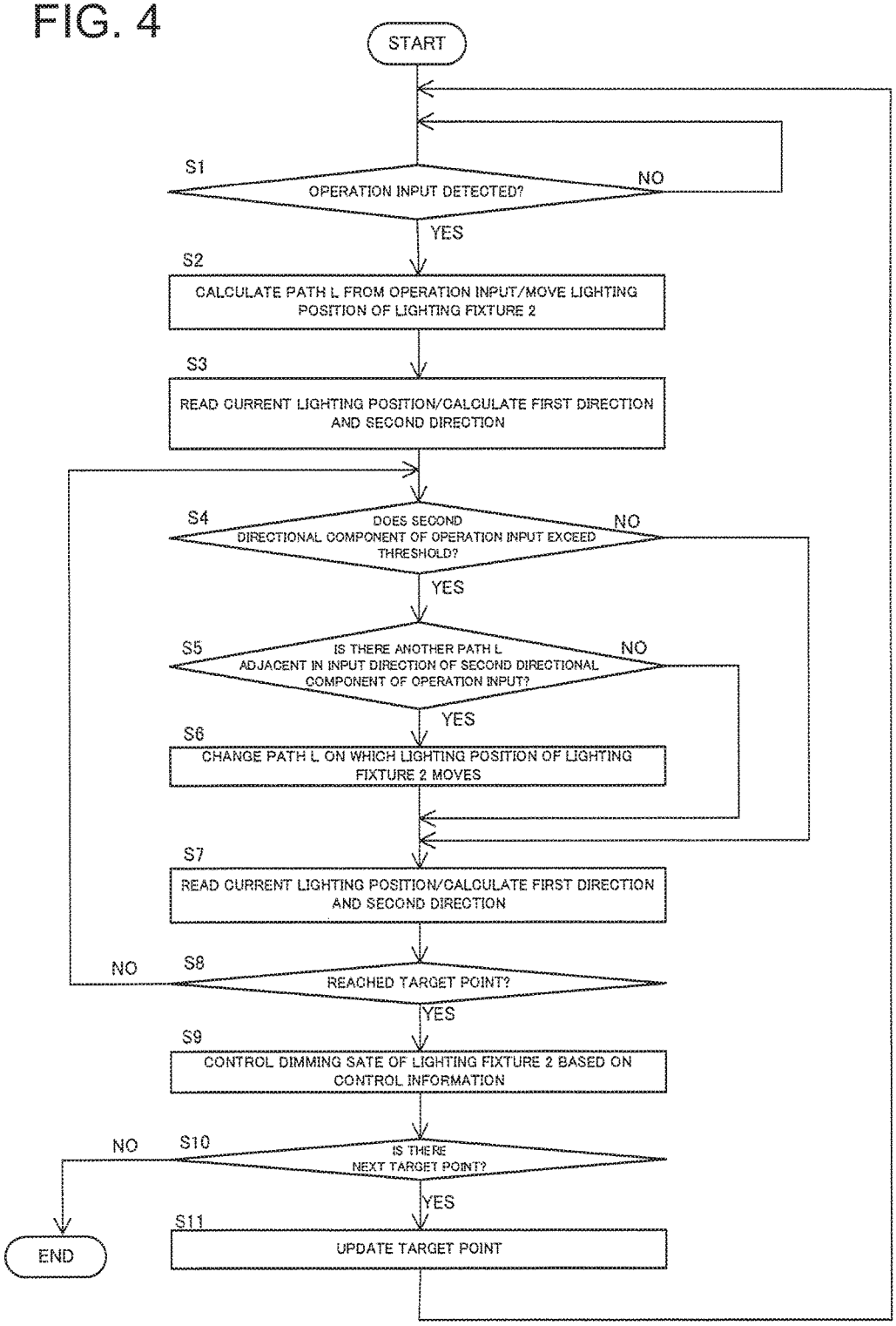
FIG. 4 is a flowchart exemplarily showing processing which a lighting control console according to an example of an embodiment performs for controlling the lighting fixture.

Hereafter, referring to FIG. 4, there is described a method of causing the lighting position of the lighting fixture 2 to track with movement of the lighting target O. FIG. 4 is a flowchart exemplarily showing processing performed by the lighting control console 10 for controlling the lighting fixture 2 to track the lighting target O. Each step in the flowchart of FIG. 4 is performed by the control device 14 of the lighting control console 10.

When the lighting control console 10 is started up and accepts an input for starting tracking operation, the lighting control console 10 starts dimming control of the lighting fixtures 2 for tracking control. The input for starting the tracking operation may be, for example, an input on the touch panel 20, or may be an input by pushing a button provided on the lighting control console 10. Examples of this input on the touch panel 20 include, for example, an input on a region corresponding to an image, for selecting a tracking operation mode, which is included in the touch panel 20 and displayed on the display 18. Moreover, in the lighting control console 10 according to the present embodiment, the tracking operation mode may be integrated into a series of lighting scenes, or the tracking operation may be started by playing back the lighting scenes without the input. Next, a screen corresponding to the tracking operation is displayed on the display 18 by the control device 14. When the storage 16 stores beforehand setting data for performing the dimming control of the lighting fixtures 2, the control device 14 reads the setting data. When the storage 16 does not store the setting data, an input of the aforementioned various kinds of information is performed and the setting data is created. The control device 14 displays the various kinds of information such as an image showing the range of the irradiation space, the points P, the position information of the individual lighting fixtures 2, and the position information of the lighting position on the display 18 based on the read or created setting data. Moreover, the control device 14 may display the route R, the paths L, the control information of the individual lighting fixtures 2, and the like on the display 18 based on the read setting data.

Next, the control device 14 starts control of the lighting fixtures 2 shown in the flowchart of FIG. 4.

In step S1, it is determined whether or not the joystick 12 receives an operation input by a user. Namely, it is determined whether or not the input amount of an input signal transmitted by the joystick 12 upon reception of the operation input exceeds the predetermined threshold. When it is determined to be affirmative (YES) in step S1, the process advances to step S2, and movement of the lighting position of the lighting fixture 2 is started. When it is determined to be negative (NO) in step S1, the determination in step S1 is repeated until the joystick 12 accepts the operation input. In step S1, the user inclines the joystick 12 in the movement direction of the lighting position, and thereby moves the lighting position of the lighting fixture 2 to start the tracking operation.

In step S2, the control device 14 transmits a control signal for instruction to move the lighting position to the lighting fixture 2. The lighting fixture 2 rotates the lighting direction to move the lighting position in response to the control signal from the control device 14. In this stage, the path L along which the lighting position moves from the start point is determined in accordance with the direction of the operation input received by the joystick 12 in step S1. Namely, the control device 14 calculates the inclination direction of the operation input received by the joystick 12, specifies the path L based on the relevant inclination direction, and starts to move the lighting position along the specified path L. The control device 14 may control the lighting fixture 2 so as to move the lighting position along the path L closest to the inclination direction of the operation input out of the plurality of paths L. Moreover, the control device 14 calculates the input amount of the first directional component of the operation input received by the joystick 12. Namely, the control device 14 calculates the first directional component of the operation input based on the input signal transmitted by the joystick 12 upon reception of the operation input, the position coordinates of the start point, and the tangential direction T of the determined path L. The control device 14 controls the lighting fixture 2 such that the movement speed of the lighting position moving from the start point becomes the speed in accordance with the calculated input amount.

In step S3, the current lighting position of the lighting fixture 2 is read, and the first direction and the second direction at the current lighting position are calculated. The current lighting position has the position coordinates designated in the control signal transmitted to the lighting fixture 2 by the control device 14. The first direction and the second direction are calculated based on the current lighting position and the shape of the path L. When the path L is a curved line, the first direction and the second direction are changing along with movement of the lighting position. In the present embodiment, the movement speed of the lighting position is set to correspond to the input amount of the first directional component of the operation input received by the joystick 12. Therefore, in the present embodiment, the lighting fixture 2 is controlled while the first direction and the second direction at the current lighting position is being updated. It is therefore possible to relieve a difference between user's operation feeling for the operation input of the joystick 12 and the actual movement speed of the lighting position corresponding to the operation input.

In step S4, it is determined whether or not the operation input accepted by the joystick 12 along the second direction (second directional component of the operation input) exceeds the predetermined threshold. Namely, the control device 14 calculates the second directional component of the operation input based on the input signal transmitted by the joystick 12 upon reception of the operation input, the position coordinates of the current lighting position, and the shape of the path L. It is determined whether or not the input amount of the calculated second directional component of the operation input exceeds the predetermined threshold. When it is determined to be affirmative (YES) in step S4, the process advances to step S5. When it is determined to be negative (NO) in step S4, the process advances to step S7.

In step S5, for the operation input that exceeds the threshold of the second directional component, it is determined whether or not another path L is adjacent in input direction of the operation input. The control device 14 performs the aforementioned determination based on the orientation of the calculated second directional component of the operation input, the position coordinates of the current lighting position, and the information of the plurality of paths L stored in the storage 16. When it is determined to be affirmative (YES) in step S5, that is, when another path L adjacent in the input direction of the relevant second directional component exists, the process advances to step S6. When it is determined to be negative (NO) in step S5, that is, when another path L adjacent in the input direction of the relevant second directional component does not exist, the process advances to step S7.

As mentioned above, as long as a affirmative determination is not made in step S5 the lighting position of the lighting fixture 2 moves without deviating from the path L by the input amount of the second directional component exceeding the threshold, even if the inclination of the operation input on the joystick 12 and the movement direction (first direction) of the lighting position deviate slightly. Therefore, compared with conventional manual control of the lighting position, positioning between the lighting target and the lighting position becomes easy, in addition to this, which relieves a tracking operation load on the user.

In step S6, the lighting position of the lighting fixture 2 is changed onto the path L adjacent in the direction corresponding to the orientation of the second directional component of the operation input. The lighting fixture 2 receives the control signal by the control device 14 to move the lighting position from the current position to the position at which the vector toward the second direction intersects the adjacent path L. As mentioned above, even if the lighting target O moves and deviates from the route R in the normal direction N (refer to FIG. 3), by largely inclining the joystick 12 in the direction corresponding to the relevant normal direction N, the lighting position can be matched with the lighting target, and the tracking operation can be subsequently performed along the updated path L.

In step S7, similarly to step S3, the current lighting position of the lighting fixture 2 is read, and the first direction and the second direction at the current lighting position are calculated.

In step S8, it is determined whether or not the lighting position reaches the target point (point P2). Namely, it is determined whether or not the position coordinates of the current lighting position read in step S7 coincide with the position coordinates of the point P2 stored in the storage 16. When it is determined to be affirmative (YES) in step S8, the process advances to step S9. When it is determined to be negative (NO) in step S8, the process is returned to step S4 and the control of the lighting position including steps S4 to S8 is subsequently performed. The control of the lighting position including steps S4 to S8 is performed until the affirmative (YES) determination is made in step S8 or until an instruction of stop or change of the series of processing is made. Moreover, the control of the lighting position including steps S4 to S8 is repeatedly performed for every elapse of a predetermined period.

In step S9, the dimming state of the lighting fixture 2 is controlled based on the control information associated with the target point (point P2) that it has reached. The control device 14 reads the control information stored in the storage 16 and associated with the point P2, and based on the relevant control information, transmits the control signal to the lighting fixture 2. As described above, in step S9, the dimming state of the lighting fixture 2 is set without user's input. For example, when there is a portion where it is desired to change the dimming state of the lighting fixture 2 on the route R on which the lighting target moves, the user designates the portion as a target point, and causes the lighting control console 10 to store a dimming state to be realized. Thereby, even without user's input, it is possible to realize change to the desired dimming state only with movement operation of the lighting position by the joystick 12.

In step S10, it is determined whether or not the next target point (for example, the point P3 shown in FIG. 3) exists. The control device 14 determines whether or not the point P3 is registered as the movement destination of the lighting target following the point P2 in the setting data stored in the storage 16. When it is determined to be affirmative (YES) in step S10, the process advances to step S11. When it is determined to be negative (NO) in step S10, the process is ended.

In step S11, the target point is updated for the next control of the lighting fixture 2. For example, the control device 14 reads the setting data stored in the storage 16, and displays the updated start point (point P2) and target point (point P3) on the display 18. After performing the process of step S11, the control device 14 returns the process again to step S1 to perform the aforementioned series of processing.

According to the aforementioned lighting control console 10, lighting system 1 and control method of the lighting fixture 2, when the lighting position of the lighting fixture 2 is caused to track the movement of the lighting target, positioning between the lighting target and the lighting position is easy, which relieves an operation load on a user. For example, even if the direction of the operation input of the joystick 12 deviates slightly with respect to the movement direction of the lighting target O, the lighting position moves on the predetermined path L without deviating, and hence, tracking can be performed by one-dimensional operation input. Moreover, even if the lighting target O deviates from the scheduled route R, the lighting position can be quickly matched with the lighting target O, and the tracking operation by one-dimensional operation input can be performed again along the updated path L.

Note that the present disclosure is not limited to the aforementioned embodiment and its modifications but can be variously improved or altered without departing from the range of the matters described in the appended claims of the present application and their equivalents.

In the aforementioned embodiment, after the affirmative (YES) determination that the lighting position reaches the target point is made in step S8, in step S9, the dimming state of the lighting fixture 2 is controlled based on the control information associated with the target point. Nevertheless, dimming control of the lighting fixture 2 based on the control information associated with the target point can be started, prior to arrival of the lighting position to the target point. For example, in the case where the dimming state is largely changed, the case where the lighting fixture 2 used is switched, or a similar case, namely rapid change of the dimming state, possibly causes an unnatural impression. In such a case, control of the dimming state may be started when the lighting position comes close to the target point, and the dimming state may be gradually changed. Otherwise, in the aforementioned case, after the lighting position reaches the target point, the lighting fixture 2 may be controlled so as to lead to gradual change to the dimming state based on the control information associated with the target point.

While in the aforementioned embodiment, the series of processing is ended when it is determined that the next target point does not exist in step S10, the control device 14 may cause the display 18 to display a screen for setting the next target point and cause the user to designate the next target point. In this case, the user makes an input using the touch panel 20 or the like to designate the target point, and after that, the control device 14 updates the target point and generates a plurality of paths L to this target point. Subsequently, the control device 14 causes the storage 16 to store the updated target point and the generated paths L, and causes the display 18 to display them. After that, the process advances to the aforementioned step S11 to perform the processing in and after step S11. Thereby, the lighting control console 10 and the lighting system 1 of the present embodiment can be used for tracking operation in the case where it is grasped that the lighting target moves among specific points while the route R on which the lighting target moves is not predetermined.

Moreover, in the aforementioned embodiment, the target point can also be updated while the lighting position is moving on the path L. For example, the display 18 is caused to display an image for accepting update of the target point. Then, when the touch panel 20 accepts an input on a portion corresponding to the relevant image, the control device 14 may cause the display 18 to display a screen for setting the next target point, and cause the user to designate the next target point. After that, similarly to the above, the target point may be updated upon reception of user's input to generate the plurality of paths L, and subsequently, to perform the processing in and after the aforementioned step S11. Thereby, for example, even if a situation arises where the lighting target O is going to move to a position where the path L does not exist, the lighting position can be moved along the newly generated path L, and subsequently, the tracking operation using the lighting control console 10 and the lighting system 1 of the present embodiment can be performed.

Moreover, in the aforementioned embodiment, there may be a mode in which switching to manual tracking operation is possible at any time point. For example, the display 18 may be caused to display an image for accepting switching to manual control of the lighting position, and the control device 14 and the like may be configured such that switching to the manual control is possible when the touch panel 20 accepts an input on a portion corresponding to the relevant image. When control of the lighting position is switched to the manual control, for example, the operation input accepted by the joystick 12 is associated with coordinates of the lighting position of the lighting fixture 2. Thereby, the user can perform the manual control of the lighting position by operation of the joystick 12. As a result, even if a sudden event happens during movement of the lighting target O, which leads to a situation that cannot be sufficiently handled by update of the target point, the tracking operation can be quickly performed, and even in the case of a suspended period of tracking lighting, the period of suspension can be kept as short as possible.

While in the aforementioned embodiment, when the negative (NO) determination is made in step S5, that is, when another path L adjacent in the input direction of the second directional component of the operation input does not exist, movement in the first direction is just simply continued, warning may also be issued in this case. Examples of the warning include, for example, display of a warning icon on the display 18, and generation of a warning sound such as buzzing. The aforementioned warning can promote the user to perform switching to the aforementioned manual tracking operation.

For the aforementioned embodiment, there has been described the case where the lighting control console 10 includes the joystick 12 and the touch panel 20 as input devices. Nevertheless, the lighting control console 10 of the present disclosure may use a known input device used for the lighting control console 10 other than the joystick 12 and the touch panel 20.

For example, for the aforementioned embodiment, there has been described the case where the joystick 12 is used as the operation device that accepts the operation input for controlling the lighting position of the lighting fixture 2. Nevertheless, the type of the input device used for the operation device is not limited as long as the input for controlling movement of the lighting position along the path L, and the input for changing the lighting position onto another adjacent path L, are possible. For example, as the operation device a known input device with which inputs in two-dimensional directions may be used, such as a trackball, a touch pad, a tablet terminal and a mouse. These two-dimensional input devices including the joystick 12 are preferable since the first operation input and the second operation input can be performed through a single operation and they can be instinctively operated. Moreover, the operation device may have a configuration in which two operation inputs independent of each other are possible by combining known input devices such as a fader, a rotary encoder, a button and a keyboard.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting control console comprising:

an operation device configured to accept an operation input for controlling a lighting fixture;

a control device that transmits a control signal for controlling the lighting fixture upon reception of an input signal transmitted by the operation device in response to the operation input; and a storage in which position information of a plurality of points existing in a predetermined space is stored, wherein in the storage, a plurality of paths connecting a first point and a second point out of the plurality of points are stored, the first point being a start point, the second point being a target point, the operation device is configured to accept, as the operation input, a first operation input and a second operation input which are independent of each other, upon reception of the input signal transmitted by the operation device in accordance with the first operation input, the control device controls the lighting fixture so as to move a lighting position of the lighting fixture from the start point toward the target point along a first path included in the plurality of paths stored in the storage, and to move the lighting position at a speed in accordance with an input amount of the first operation input, and the control device controls the lighting fixture so as to change the lighting position onto a second path adjacent to the first path when the input signal transmitted by the operation device in accordance with the second operation input while moving the lighting position along the first path exceeds a predetermined threshold.

2. The lighting control console according to claim 1, wherein the operation device is a joystick configured to accept the first and second operation inputs in two-dimensional directions, the first operation input is an input to the joystick in a first direction of the two-dimensional directions, and the second operation input is an input to the joystick in a second direction of the two-dimensional directions and perpendicular to the first direction.

3. The lighting control console according to claim 1, wherein the storage stores control information regarding control of dimming state of the lighting fixture, the dimming state being associated with each of the plurality of points, and the control device controls the lighting fixture such that the dimming state of the lighting fixture becomes a dimming state associated with the target point based on the control information stored in the storage when the lighting position reaches the target point.

4. The lighting control console according to claim 1, further comprising an input device configured to accept an input for updating the target point, wherein when the input device accepts the input for updating the target point, the control device controls the lighting fixture so as to create a plurality of paths connecting a current point at which the lighting position exists and the updated target point based on position information of the updated target point, and so as to move the lighting position of the lighting fixture along one path included in the created plurality of paths.

5. A lighting system comprising:

a lighting control console comprising, an operation device configured to accept an operation input for controlling a lighting fixture, a control device that transmits a control signal for controlling the lighting fixture upon reception of an input signal transmitted by the operation device in response to the operation input, and a storage in which position information of a plurality of points existing in a predetermined space is stored, wherein in the storage, a plurality of paths connecting a first point and a second point out of the plurality of points are stored, the first point being a start point, the second point being a target point, the operation device is configured to accept, as the operation input, a first operation input and a second operation input which are independent of each other, upon reception of the input signal transmitted by the operation device in accordance with the first operation input, the control device controls the lighting fixture so as to move a lighting position of the lighting fixture from the start point toward the target point along a first path included in the plurality of paths stored in the storage, and to move the lighting position at a speed in accordance with an input amount of the first operation input, and the control device controls the lighting fixture so as to change the lighting position onto a second path adjacent to the first path when the input signal transmitted by the operation device in accordance with the second operation input while moving the lighting position along the first path exceeds a predetermined threshold; and a lighting fixture, a lighting position of which is movable, and which moves the lighting position in response to the control signal transmitted by the control device included in the lighting control console.

6. A control method comprising:

providing a lighting control console, wherein the lighting control console comprises an operation device configured to accept an operation input for controlling a lighting fixture, a control device that transmits a signal for controlling the lighting fixture to the lighting fixture upon reception of an input signal transmitted by the operation device in response to the operation input, and a storage in which position information of a plurality of points existing in a predetermined space is stored, wherein in the storage, a plurality of paths connecting a first point and a second point out of the plurality of points are stored, the first point being a start point, the second point being a target point, and the operation device being configured to accept, as the operation input, a first operation input and a second operation input which are independent of each other;

when the operation device receives the first operation input, moving a lighting position of the lighting fixture using the control device from the start point toward the target point along a first path included in the plurality of paths stored in the storage at a speed in accordance with an input amount of the first operation input; and changing the lighting position of the lighting fixture using the control device onto a second path adjacent to the first path when the operation device accepts the second operation input having an input amount exceeding a predetermined threshold during the step of moving the lighting position of the lighting fixture.

7. The control method according to claim 6, further comprising the step of when the lighting position reaches the target point, reading control information regarding control of dimming state of the lighting fixture using the control device, the dimming state being associated with the target point, the control information being stored in the storage, and controlling the lighting fixture such that the dimming state of the lighting fixture becomes the dimming state associated with the target point based on the read control information.

8. The control method according to claim 6, wherein the operation device is a joystick that accepts the first and second operation inputs in two-dimensional directions, the first operation input is an input to the joystick in a first direction of the two-dimensional directions, and the second operation input is an input to the joystick in a second direction of the two-dimensional directions and perpendicular to the first direction.

* * * * *